United States Patent [19]

Hibell

[11] 4,171,677

[45] Oct. 23, 1979

[54] HORN FLARE

[75] Inventor: Ernest G. Hibell, Birmingham, England

[73] Assignee: Lucas Industries Limited, Great Britain

[21] Appl. No.: 929,962

[22] Filed: Aug. 1, 1978

[30] Foreign Application Priority Data

Aug. 27, 1977 [GB] United Kingdom ..... 36104/77

[51] Int. Cl.[2] ..... G08B 3/10

[52] U.S. Cl. ..... 116/137 R; 116/142 R; 340/404

[58] Field of Search ..... 116/142 R, 142 FP, 142 FV, 116/143, 144, 145, 146, 137 R; 181/194; 340/404, 388

[56] References Cited

U.S. PATENT DOCUMENTS

| | | | |
|---|---|---|---|
| 1,366,493 | 1/1921 | Reynolds | 116/137 R |
| 1,748,790 | 2/1930 | Osborne | 181/194 |
| 2,058,555 | 10/1936 | Betts | 181/194 |

FOREIGN PATENT DOCUMENTS

| | | | |
|---|---|---|---|
| 1432363 | 4/1976 | United Kingdom | 340/404 |

*Primary Examiner*—S. Clement Swisher
*Assistant Examiner*—Denis E. Corr
*Attorney, Agent, or Firm*—Staas & Halsey

[57] ABSTRACT

A horn flare has first and second plastics mouldings which are welded or adhesively secured together. The first moulding has an end wall having a central opening aligned with the space inside a first annular wall extending integrally from the end wall. A further integral annular wall surrounds the first annular wall and a collar having a stepped annular recess therein surrounds an additional wall. The second moulding has an end wall which overlies the first annular wall and the further integral annular wall. Extending integrally from the end wall of the second moulding are said additional wall and a further wall. The additional wall lies between the first annular wall and the further integral annular wall while the further wall of the second moulding lies outside said further integral annular wall of the first moulding. The second moulding further includes an open-ended flared sleeve which is integrally connected with the further wall of the second moulding by spaced lugs. One end of the sleeve has an annular tongue which engages in the recess to hold the mouldings apart so that a sinuous air passage is defined between the mouldings.

7 Claims, 4 Drawing Figures

HORN FLARE

BACKGROUND AND SUMMARY OF INVENTION

This invention relates to a horn flare and more particularly, though not exclusively, to a horn flare used in conjunction with a solenoid-operated diaphragm horn for a motor vehicle.

Horn flares are known which are composed of two interengaging parts which together define between them a sinuous air passage. In one such horn flare, (as disclosed in British Patent Specification No. 1432363 corresponding to Japanese Provisional Publication No. 49-51895), two mouldings each have concentrically arranged spaced annular walls which extend integrally from an end wall. The two mouldings are interengaged so that the annular walls in each moulding engage in spaces in the other moulding with the free ends of the annular walls of each moulding being spaced from the end wall of the other moulding, so that a sinuous passage having runs extending axially of the horn flare is defined between the mouldings. In order to fix the mouldings in the required mutual disposition both radially and axially, such horn flare is provided with three equi-angularly spaced spacer lugs which extend radially and integrally from one of the annular walls of one moulding to engage against one of the annular walls of the other moulding. It is to be appreciated that the two last mentioned annular walls are not mutually parallel, (i) because of the dimensional changes required along the length of the air passage for horn performance purposes, and (ii) for ease of mould tool separation during formation of the mouldings. Thus, during assembly of the horn flare, the two mouldings are interengaged until the spacer lugs on one of the mouldings engages against the respective annular wall of the other moulding and then ultrasonically welded three radially movable probes to effect welding in the region of the lugs. However, if the two mouldings are engaged with excessive force, it will be appreciated that the walls can be deformed with the result that the required spacing is not obtained between the two mouldings, so that the shape of the air passage is altered and the performance of the horn flare suffers. Furthermore, problems are created in the welding together of the two mouldings because precise positioning and synchronisation of the ultrasonic welding probes are required to obtain the required spacing between the mouldings.

It is an object of the present invention to obviate or mitigate this disadvantage.

According to the present invention, there is provided a horn flare comprising first and second mutually interengaged mouldings and means interconnecting the two mouldings, said first moulding having a first end wall and a first annular wall extending integrally from one end face of the first end wall, the first end wall having an opening therethrough which communicates with the space internally of the first annular wall, the second moulding having a second end wall, a second annular wall extending integrally from the second end wall so that the latter closes one end of the second annular wall, a further wall surrounding the second annular wall, said interconnecting means holding the mouldings in the desired mutual disposition so that the free end of the annular wall of each moulding is spaced from the respective end wall of the other moulding whereby a sinuous air passage is defined by the interengaged mouldings, characterised in that the further wall is in the form of an open-ended sleeve, spacer means integrally interconnect the sleeve with the second annular wall, and the interconnecting means comprises an interengaging lug and recess arrangement between the sleeve and the first end wall.

The provision of the interengaging lug and recess arrangement between one end of the sleeve and the first end wall ensures that a positive engagement can be made between the two mouldings consistently.

Preferably, the interengaging lug and recess arrangement comprises an annular collar extending from said one face of the first end wall and having an annular recess in its free end, and an annular lug extending from said one end of the sleeve.

It is within the scope of the present invention to provide each moulding with one or more additional annular walls, the additional wall or walls on the first moulding being spaced outwardly of the first annular wall and the additional wall or walls on the second moulding being spaced inwardly of the second annular wall, whereby the length of the air passage is increased.

An embodiment of the present invention will now be described, by way of example, with reference to the accompanying drawings, in which:

DESCRIPTION OF THE PREFERRED EMBODIMENT

Figure 1:
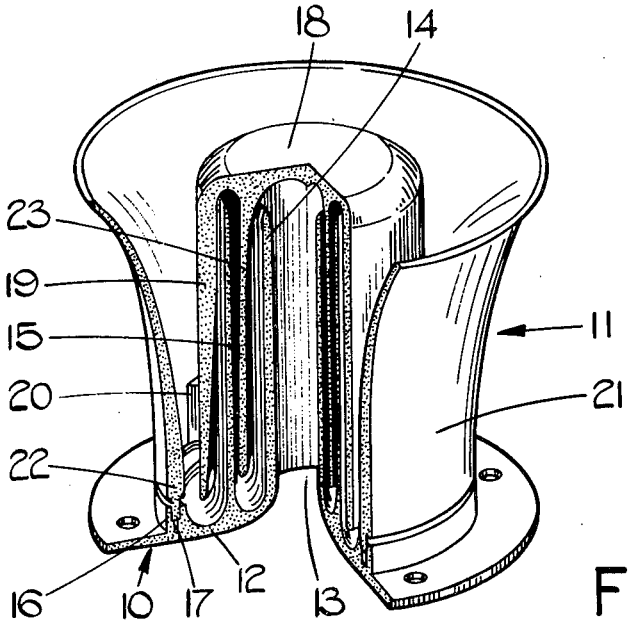
FIG. 1 is a part cut-away perspective view of one embodiment of a horn flare according to the present invention, shown before welding.

Referring to the drawing, the horn flare illustrated therein is intended to be secured to the body of a solenoid-operated vibrating diaphragm horn for a motor vehicle. The horn flare comprises first and second plastics mouldings 10 and 11 respectively which are mutually interengaged. The first moulding comprises a first end wall 12 which has a central opening 13 therethrough. Extending integrally from one face of the first end wall 12 is a first annular wall 14 of circular cross-section. The central opening 13 communicates with the space inside the wall 14 as will be apparent from FIG. 1; the diameter of the opening 13 on said one face of the end wall 12 is the same as the internal diameter of the annular wall 14. On the opposite face of the first end wall 12, the opening 13 has a diameter which is greater than its diameter at said one face of the first end wall 12. This is provided in order to obtain the desired performance from the diaphragm which is located, in use, under the said other face of the first end wall 12. The first moulding is further provided with an additional annular wall 15 which is spaced outwardly of the first annular wall 14. The first moulding 10 is also provided with an annular collar 16 extending integrally from said one face of the first end wall 12. The collar 16 is spaced outwardly of the additional annular wall 15. The free end of the collar 16, i.e. that end remote from said one face of the end wall 12, has an annular recess 17 therein. The second moulding 11 has a second end wall 18 and a second annular wall 19 extending from one face thereof. The second end wall 18 closes one end of the second annular wall, i.e. closes one end of the space within the wall. Adjacent the free end of the annular wall 19, i.e. adjacent the end remote from the end wall 18, there are provided a series of three equiangularly spaced lugs 20 which extend radially outwardly and integrally from the annular wall 19. The lugs 20 are integral with an outer sleeve 21 which also forms part of the second moulding 11. The outer sleeve 21 surrounds the annular wall 19 and is flared outwardly in the direction of the second end wall 18. At its end adjacent the free end of the second annular wall 19, the outer sleeve 21 is provided with an annular lug or tongue 22 which extends axially of the second moulding 11. The diameter of the tongue 22 is the same as that of the annular recess 17 in the first moulding 10. The second moulding 11 is also provided with an additional annular wall 23 which extends integrally from the second end wall 18 and is spaced inwardly of the second annular wall 19.

Figure 2:
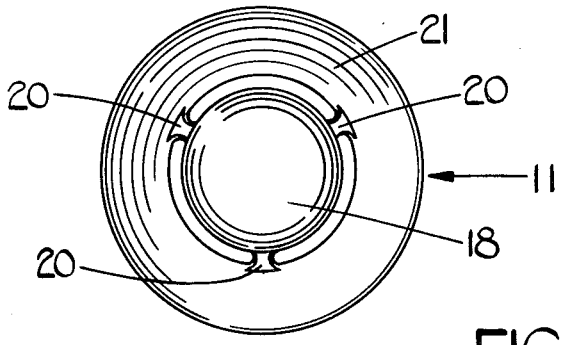
FIG. 2 is a plan view of the horn flare of FIG. 1.

As will be apparent from FIG. 1, the first and second mouldings 10 and 11 are interengaged by locating the tongue 22 in the recess 17, and are received together in a manner to be described hereinafter to effect permanent connection between the tongue 22 and the collar 16. In this position, the first annular wall 14 is surrounded by the additional annular wall 23 which in turn is surrounded by the additional annular wall 15 which in turn is surrounded by the second annular wall 19. The dimensions of the sleeve 21 and walls 14, 15, 19 and 23 are so chosen that when the mouldings 10 and 11 are interengaged, the free ends of the walls 14 and 15 are spaced from the end wall 18 whilst the free ends of the walls 19 and 23 are spaced from the end wall 12. In this manner, there is defined between the first and second mouldings 10 and 11 a sinuous air passage which extends from the opening 13 around the free end of the wall 14, between the walls 23 and 14, around the free end of the wall 23, between the wall 23 and the wall 15, around the free end of the wall 15, between the wall 15 and the wall 19, around the free end of the wall 19, and between the wall 19 and the sleeve 21 to terminate at the outwardly flared end of the sleeve 21. As will be apparent from FIG. 2, the lugs 20 do not obscure the portion of the air passage between the wall 19 and the sleeve 21 to any great extent.

Figure 3:
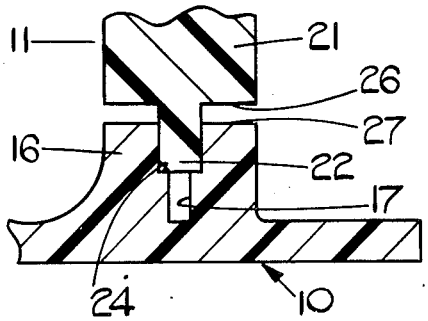
FIG. 3 is a detail of the flare of FIG. 1 before welding.
Figure 4:
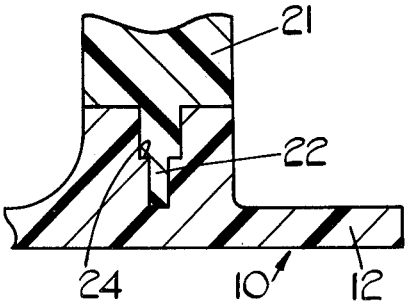
FIG. 4 is a detail of the flare of FIG. 2 after welding.

Referring now to FIGS. 3 and 4, the recess 17 in the collar 16 is provided with a step 24 against which the end of the tongue 22 rests when the two mouldings 10 and 11 are interengaged. Then the first and second mouldings 10 and 11 are ultrasonically welded together using welding probes which engage against opposite ends of the respective mouldings 10 and 11 to urge the tongue 22 against the step 24. During the welding operation, the tongue 22 is deformed until respective surface 26 and 27 on the mouldings 10 and 11 come into mutual abutment, at which stage the deformed tongue 22 substantially fills the recess 17.

In an alternative embodiment, an adhesive in the recess serves to secure the mouldings 10 and 11 together.

It will be apparent that the above described horn flare is easy to assemble and that, because of the positive interengagement between the end wall 12 and sleeve 21, the horn flares can be mass produced with consistently dimensioned air passages therein.

I claim:

1. A horn flare comprising first and second mutually interengaged mouldings and means interconnecting the two mouldings, said first moulding having a first end wall and a first annular wall extending integrally from one end face of the first end wall, the first end wall having an opening therethrough which communicates with the space internally of the first annular wall, the second moulding having a second end wall, a second annular wall extending integrally from the second end wall so that the latter closes one end of the second annular wall, a further wall being a part of said second moulding surrounding the second annular wall said interconnecting means holding the mouldings in the desired mutual disposition so that the free end of the annular wall of each moulding is spaced from the respective end wall of the other moulding whereby sinuous air passage is defined by the interengaged mouldings, characterized in that the further wall is in the form of an open-ended sleeve, spacer means integrally interconnect the sleeve with the second annular wall, and the interconnecting means comprises an interengaging tongue and recess arrangement between the sleeve and the first end wall.

2. A horn flare as claimed in claim 1, characterized in that the interengaging tongue and recess arrangement comprises an annular collar extending from said one face of the first end wall and having an annular recess in it free end, and an annular tongue extending from said one end of the sleeve.

3. A horn flare as claimed in claim 2, wherein the recess is provided with a step against which the tongue engages.

4. A horn flare comprising:

first and second mutually interengaged moldings;

means interconnecting the two moldings;

said first molding having a first end wall and an integral first annular wall extending from one end face of the first end wall, the first end wall having an opening therethrough which communicates with the space internally of the first annular wall;

said second molding having a second end wall, an integral second annular wall extending from the second end wall for closing one end of the second annular wall, and said second molding having a further wall surrounding the second annular wall;

said interconnecting means holding the said first and second moldings in the desired mutually interengaged relationship so that the free end of the annular wall of each molding is spaced from the respective end wall of the other molding thereby providing an air passage between the interengaged moldings;

said further wall being in the form of an open-ended sleeve;

spacer means integrally interconnecting the sleeve with the second annular wall; and said interconnecting means including an annular tongue extending from one end of said sleeve and interengaging with a recess provided in an annular collar extending from said first end wall.

5. A horn flare as claimed in claim 4, wherein said recess is provided with a step against which the tongue engages.

6. A horn flare as claimed in claim 4, wherein said tongue is ultrasonically welded within said recess to secure said first and second moldings together in a permanent manner with consistently dimensioned air passages within the horn flare.

7. A horn flare as claimed in claim 4, wherein said tongue is adhesively secured within said recess for the purpose of providing positively interengagement to secure said first and second moldings together with consistently dimensioned air passages within the horn flare.

* * * * *